US008950630B2

(12) United States Patent
Jackson

(10) Patent No.: US 8,950,630 B2
(45) Date of Patent: Feb. 10, 2015

(54) RECLOSABLE DISPENSER

(76) Inventor: Bruce D. Jackson, San Francisco, CA (US)

( * ) Notice: Subject to any disclaimer, the term of this patent is extended or adjusted under 35 U.S.C. 154(b) by 2929 days.

(21) Appl. No.: 10/631,771

(22) Filed: Aug. 1, 2003

(65) Prior Publication Data

US 2005/0006387 A1 Jan. 13, 2005

Related U.S. Application Data

(60) Provisional application No. 60/484,670, filed on Jul. 7, 2003.

(51) Int. Cl.

| | |
|---|---|
| ***B65D 51/20*** | (2006.01) |
| ***B65D 47/08*** | (2006.01) |
| ***B65D 25/04*** | (2006.01) |
| *B65D 81/20* | (2006.01) |

(52) U.S. Cl.

CPC ..... *B65D 47/0847* (2013.01); *B65D 25/04* (2013.01); *B65D 51/20* (2013.01); *B65D 81/20* (2013.01); *B65D 81/2015* (2013.01)

USPC ..... 222/144.5; 222/94

(58) Field of Classification Search

USPC ..... 220/253, 262, 263, 264, 259.1, 259.2, 220/254.3, 250, 906; 222/94, 129, 144.5; 215/235

See application file for complete search history.

(56) References Cited

U.S. PATENT DOCUMENTS

| | | | | |
|---|---|---|---|---|
| 1,667,818 | A * | 5/1928 | Page | 222/144.5 |
| 1,896,976 | A * | 2/1933 | Schifferdecker | 220/253 |
| 2,686,007 | A * | 8/1954 | Hurtig et. al. | 232/4 R |
| 3,831,743 | A * | 8/1974 | Leedy | 221/212 |
| 3,850,350 | A | 11/1974 | Towns et al. | |
| 4,262,802 | A * | 4/1981 | Laauwe | 206/540 |
| 4,288,006 | A * | 9/1981 | Clover, Jr. | 222/42 |
| 4,503,990 | A * | 3/1985 | Roth et al. | 220/276 |
| 4,607,768 | A | 8/1986 | Taber et al. | |
| 4,724,979 | A * | 2/1988 | Cleevely et al. | 220/258.2 |
| 4,901,892 | A * | 2/1990 | Song | 222/498 |
| 4,919,295 | A * | 4/1990 | Hitzler | 220/23.83 |
| 5,088,614 | A * | 2/1992 | Dumestre | 220/713 |
| 5,122,571 | A | 6/1992 | Westeppe et al. | |
| 5,339,993 | A | 8/1994 | Groya et al. | |
| 5,402,904 | A * | 4/1995 | Close | 220/254.3 |
| 5,445,287 | A * | 8/1995 | Center et al. | 221/1 |
| 5,492,244 | A * | 2/1996 | Kim | 220/524 |
| 5,845,816 | A * | 12/1998 | Krane | 222/142.9 |
| 5,890,627 | A * | 4/1999 | Storey | 222/129 |
| 5,927,535 | A * | 7/1999 | Goth | 220/254.3 |

(Continued)

FOREIGN PATENT DOCUMENTS

| | | |
|---|---|---|
| JP | 2120352 | 5/1990 |
| JP | 9504750 | 5/1997 |

(Continued)

OTHER PUBLICATIONS

Japanese Office Action 2006-518631 Sep. 29, 2009 with English Translation.

*Primary Examiner* — Timothy Waggoner
(74) *Attorney, Agent, or Firm* — Sughrue Mion, PLLC

(57) ABSTRACT

A can with an internal divider for separating multiple items to be dispensed, and a dispensing cap having one-handed operation for opening and closing and suitable for effectively dispensing one or more items from a container which may or may not have an internal divider.

15 Claims, 5 Drawing Sheets

(56) References Cited

U.S. PATENT DOCUMENTS

| | | | | |
|---|---|---|---|---|
| 5,947,324 | A * | 9/1999 | Palinchak | 220/713 |
| 5,974,324 | A * | 10/1999 | Henson | 455/447 |
| 6,073,797 | A * | 6/2000 | Barous | 220/716 |
| 6,119,890 | A | 9/2000 | Kawamata | |
| 6,196,412 | B1 * | 3/2001 | Cattell | 220/524 |
| 6,460,759 | B1 * | 10/2002 | Lowry et al. | 229/201 |
| 6,497,344 | B1 * | 12/2002 | Dial | 222/144.5 |
| 6,742,666 | B1 * | 6/2004 | Bried et al. | 215/235 |
| 6,820,767 | B2 * | 11/2004 | Nicholas | 222/144.5 |

FOREIGN PATENT DOCUMENTS

| | | |
|---|---|---|
| JP | 11216528 | 8/1999 |
| JP | 11332719 | 12/1999 |
| WO | 9508442 A1 | 3/1995 |

* cited by examiner

RECLOSABLE DISPENSER

This application claims domestic priority under 35 U.S.C. §119(e) to Provisional Application No. 60/484,670, filed on Jul. 7, 2003, the entire disclosure which is hereby incorporated by reference.

BACKGROUND OF THE INVENTION

The present invention is directed to improved container, and particularly a container for consumables.

Solid consumable items such as peanuts, cashews, etc., have been dispensed for some time in a variety of containers, including aluminum cans, glass and plastic jars, composite cans (also called fiber cans), three-steel cans and two-piece DRD (draw-redraw) steel cans. However, the cans are such that the fabrication of the can and the filling and sealing of the can are not optimal. An improved can structure and assembly technique would be beneficial. An improved dispensing cap would also be beneficial.

Further, in the case of both solid and liquid consumables, there has been no effective resealable container capable of maintaining separation between plural types of consumables.

SUMMARY OF THE INVENTION

It is an object of the invention to provide an improved container for solid consumables.

It is a further object of the invention to provide an improved container for plural different consumables.

It is a still further object of this invention to provide an improved dispensing cap.

These and other objects of the invention are achieved by a DWI container for solid consumables, together with a method of manufacturing and method of filling such a container.

The objects of the invention are further achieved by a dispensing cap which can be opened and resealed in a one-handed operation.

The objects of the invention are further achieved by a container having an internal separator for maintaining separation between plural different consumables, and a dispensing cap which permits dispensing of the separate items while also permitting resealing of the container and preserving the separation of the items.

BRIEF DESCRIPTION OF THE DRAWINGS

The invention will be more clearly understood from the following description in conjunction with the accompanying drawings, in which.

DETAILED DESCRIPTION OF THE INVENTION

Figure 1:
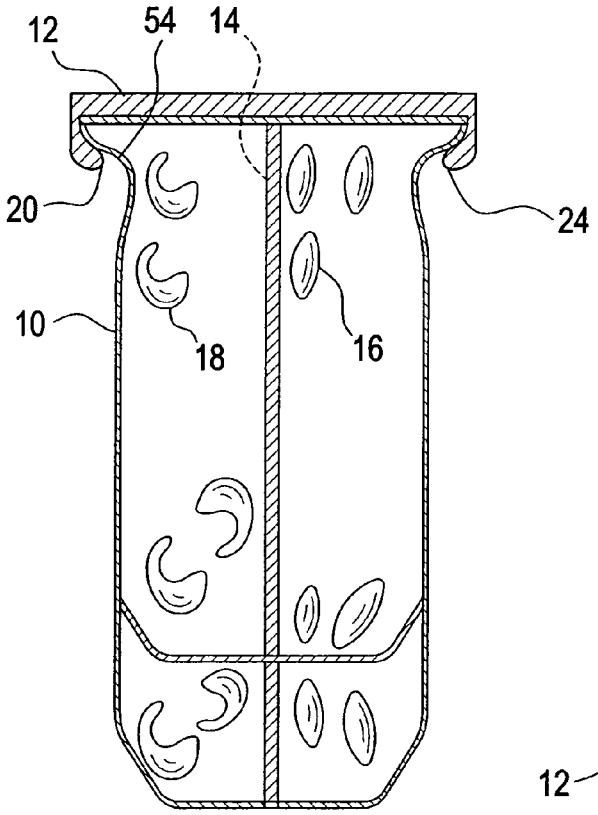
FIG. 1 shows a diagrammatic side elevation of a container according to a first embodiment of the present invention.

FIG. 1 shows a diagrammatic side elevation of a container according to a first embodiment of the present invention. The can comprises an aluminum body 10, a plastic cap 12 and an optional internal divider 14. The divider 14 allows separate storage of different consumables. Illustrated in FIG. 1 are almonds 16 and cashews 18, although these are by way of example only and it will be readily appreciated that those aspects of the invention applicable to solid consumables are applicable to any solid consumables and not simply different types of nuts, and those aspects of the invention applicable to liquid consumables are applicable to any liquid consumables and not simply those that will be described here by way of example.

Figure 2A:
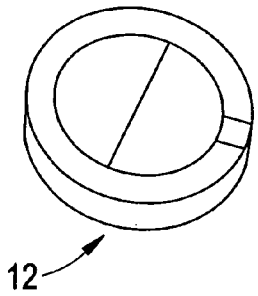
FIG. 2*a* illustrates one example of a cap according to the present invention, from a top perspective view with the cap closed.
Figure 2B:
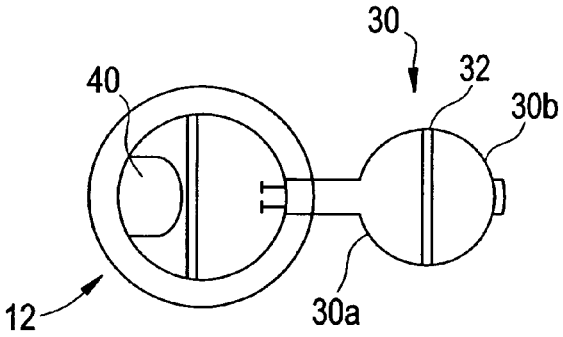
FIG. 2*b* shows the same cap open, from a top plan view.
Figure 2C:
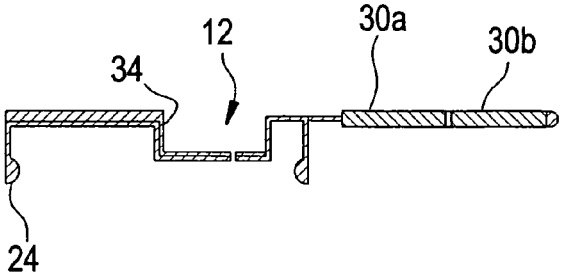
FIG. 2*c* is a side elevation of the cap shown in FIG. 2*b;*
Figure 2D:
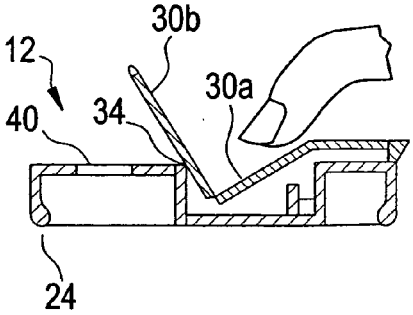
FIG. 2*d* is a side sectional view of the cap as it is being opened after the first time.

FIG. 2*a* illustrates one example of a cap 12 according to the present invention, from a top perspective view with the cap closed. FIG. 2*b* shows the same cap open, from a top plan view. FIG. 2*c* is a side elevation of the cap shown in FIG. 2*b*, and FIG. 2*d* is a side sectional view of the cap as it is being opened after the first time. As shown collectively in these figures, the can includes a lip 20 at its upper end, and the cap 12 includes an inwardly facing lip 24 at its lower periphery for holding the upper lip of the can. The lip 24 can be a continuous circumferential bead or may be intermittent projections.

The container is initially prepared by a process known in the art, e.g., a DWI technique. The optional divider can be separately fabricated and inserted or it can be fabricated initially with the can body. The can is filled with nuts and is then sealed by providing a tear-away lid, preferably of aluminum. The plastic cap 12 is then placed over the lid. To open initially, the plastic cap is removed, the tear-away lid is removed, and the plastic cap is then replaced over the open end of the can.

The cap includes a closure 30 having portions 30*a* and 30*b* demarcated by a crease or a cut 32 that leaves a thin portion of the upper surface of the closure 30 to act as a hinge. When the region 30*a* is pressed downwardly, the region 30*b* abuts the edge 34 and pivots about the contact point, so that continued pressure on the region 30*a* results in lifting the region 30*b* to expose the opening 40. The materials and dimensions are preferably selected such that the portion 30*b* will remain in the position substantially as shown in FIG. 2*d* until portion 30*b* is pushed down for resealing the container. Partial or complete tilting of the can with the closure 30 in the configuration shown in FIG. 2*d* will allow the contents in the chamber underneath the opening to be poured from the container. Selection of which item to dispense is by rotating the container either before or after opening the lid.

Figure 3A:
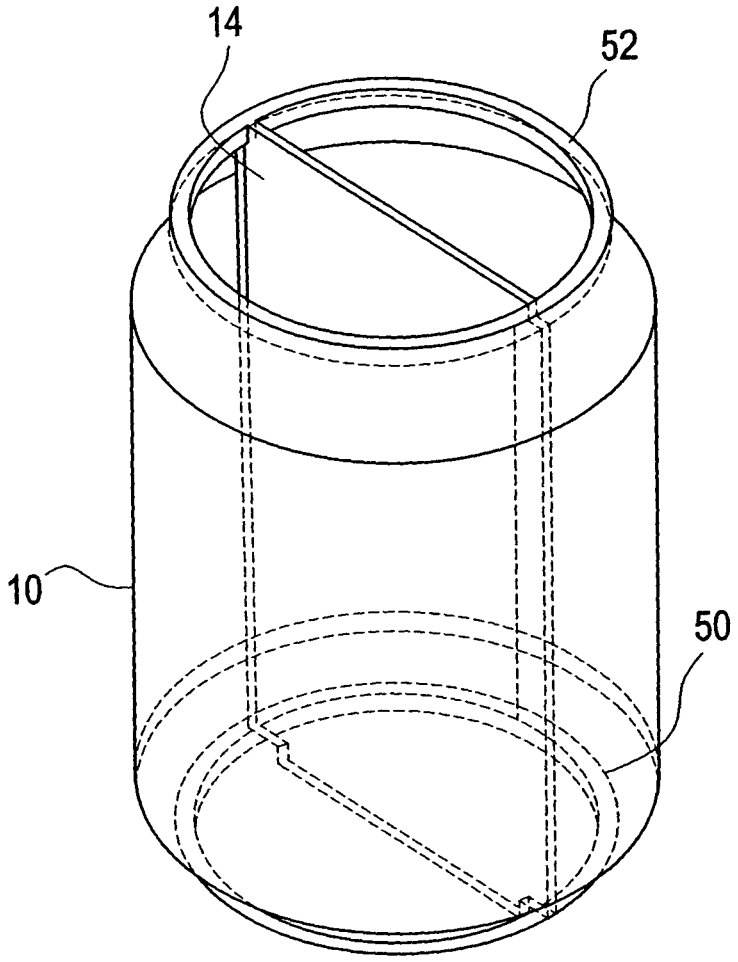
FIGS. 3*a*-3*c* are an illustration of a can and its internal divider.
Figure 3B:
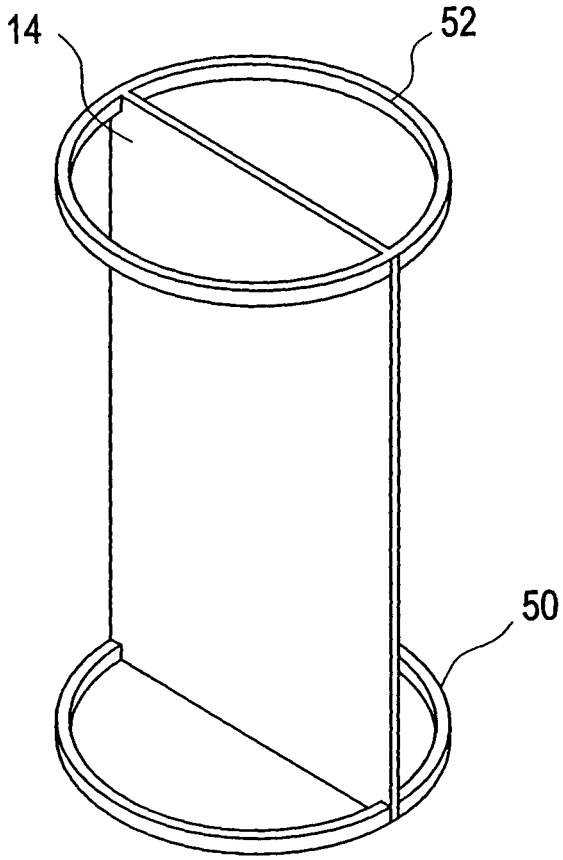
Figure 3C:
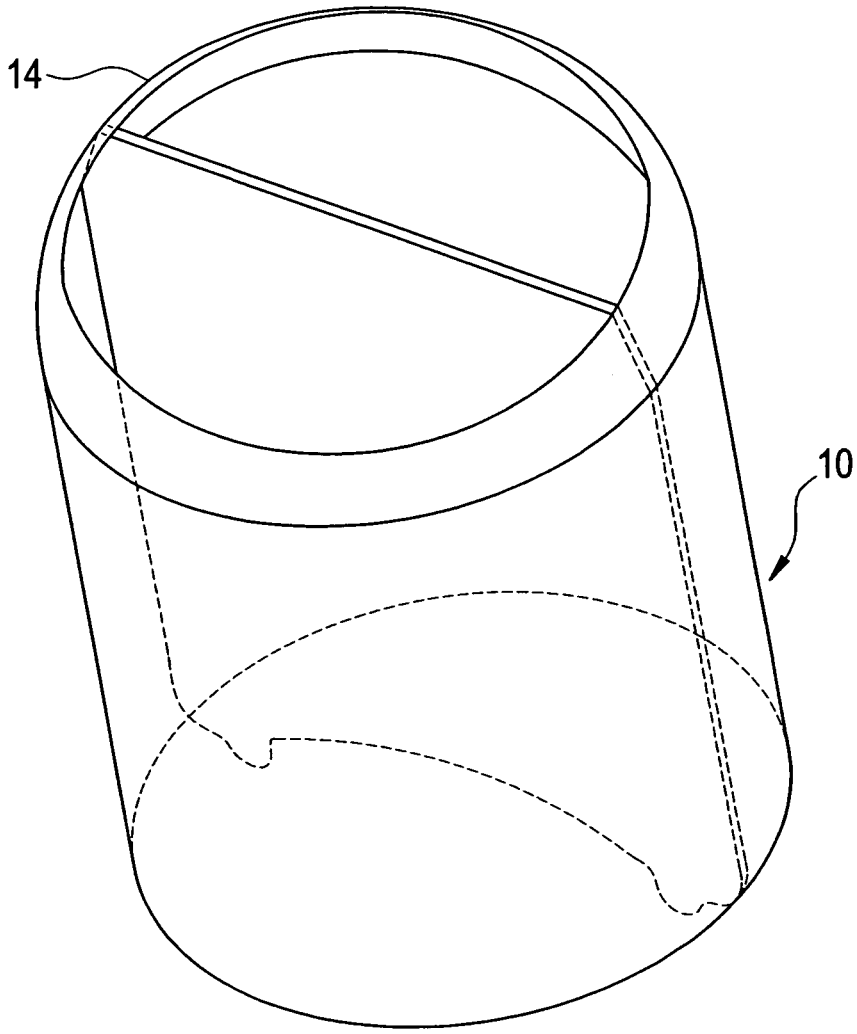
Figure 4B:
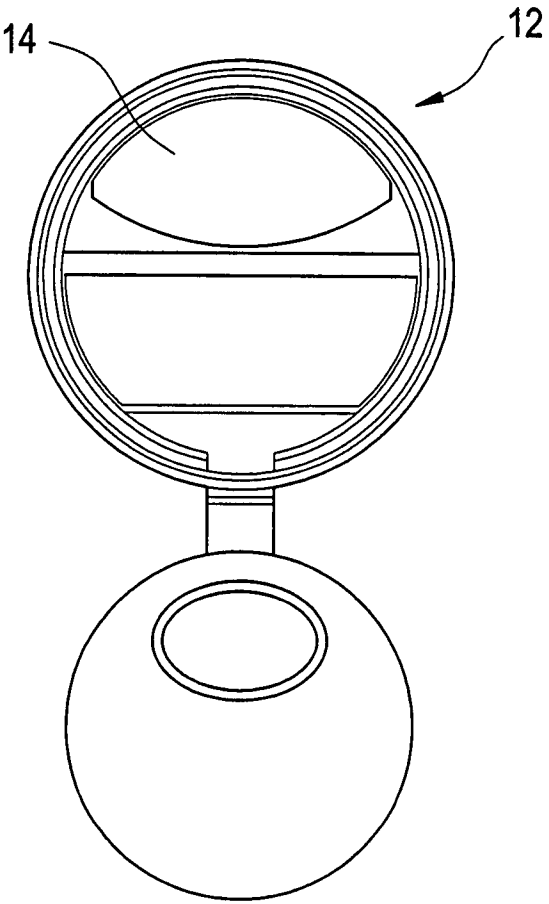
FIGS. 4*a* and 4*b* are illustrations of an implementation of a closure system schematically shown in FIGS. 2*a*-2*d*.
Figure 4A:
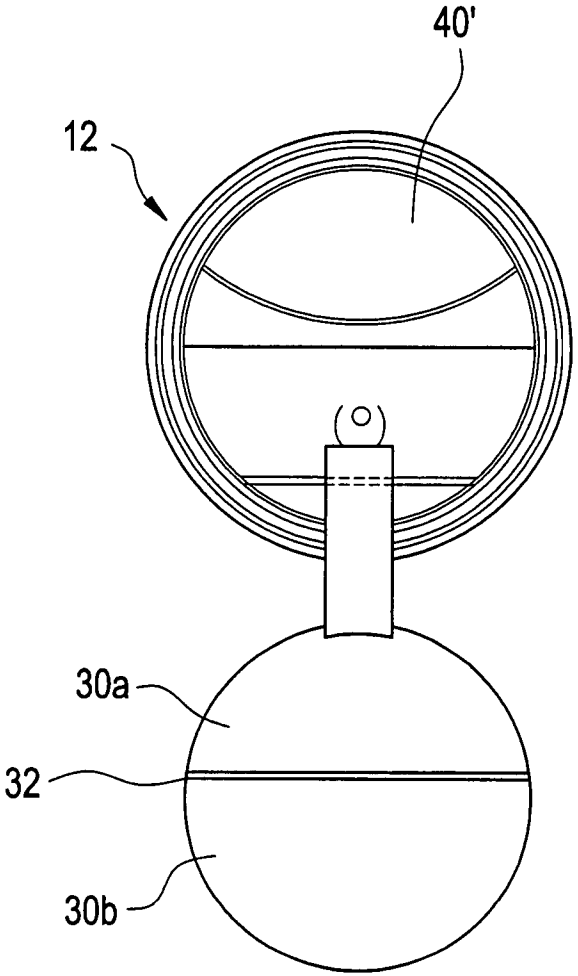

Referring to FIGS. 3*a* and 3*b*, the can bottom and side of the two-piece DWI can 10 are formed as one piece, only the top end is seamed on the one open end of the can. If a three-piece can is employed, the can body and the can top and can bottom would be formed as separate pieces. The two-piece cans are predominantly aluminium (especially in the US) but are also made of steel (mostly in Europe).

The divider 14 will be made separately and inserted into the can through the open top (in the case of a two-piece can). In order to keep the divider upright and in the middle of the can, it will be necessary to support the divider at the bottom, and this is can be done by a ring 50 as shown in FIGS. 3*a* and 3*b*. The ring 52 may be provided at the top for support as well, but also to fit just inside the open top and underneath the remains of the removed tear away aluminium top. Since the opening of the can (the diameter of which limits the diametrical dimension of the divider) is of a smaller diameter than the body of the can, there may be a small gap between the ends of the divider and the sidewall of the can, but most of the nuts will not push through the gap during the filling process. In the case of cashew/peanuts the cashews are bigger than the peanuts so would be filled first and they are too big to fall through the gap, so when the peanuts are filled they will not be able to displace the cashews but rather fill their side of the chamber only.

The rings will ideally fit with the bottom contour of the ring just outside the concave part of the bottom and the top ring inside the neck of the can. The top ring will be the maximum size that fits into the opening of the can and be positioned on the necked-in portion (shoulder 54 shown in FIG. 1). When the top end is seamed on the can, it is one-piece, but when the tear-away portion of the top end is removed there are really two pieces: one you have in your hand and one that stays seamed on the can. The inside diameter of the can is slightly smaller than before seaming because the piece that remains seamed on the can extends slightly to the inside of the can. In fact that is called the "cut edge" and the design of the end must have cut edge protection so fingers don't get cut if they come in contact with the edge.

That cut edge will provide interference for the top ring and keep it from coming out of the can if the can is turned upside down as in someone dispensing the nuts without the plastic cap.

The invention is particularly suitable for dispensing peanuts and other tree nuts such as almonds, pistachios, macadamias and others in a range of different-size two-piece DWI cans. For the mixed nut cans the nuts can simply be mixed without the divider, or a divider can be placed in the can to separate the varieties of nut types, e.g., two, three, four or even more varieties.

The nuts could be roasted, the can could be filled with nuts, liquid nitrogen added to evacuate the oxygen and give the can rigidity, a full open aluminium end seamed on, then the plastic cap with shaker feature placed on the full can. If desired, a vacuum may be used to obtain a full or partial vacuum in the container prior to filling, and/or nitrogen gas may be introduced into the container prior to filling for the total elimination of oxygen.

The consumer will remove the plastic shaker cap, open the can with the full open end, replace the shaker cap, and is now ready to use with one hand to open the shaker cap and pour the nuts into the hand or directly into the mouth. The shaker cap can be resealed with one hand by pushing the open flap with a finger.

The package and product will be very useful in the snack food market. A 250 ml can may hold about 150 gm or 5 oz of nuts, which may be a single or maybe two-three serving size.

The attributes are:

Single serve

No messy hands

Nobody else's dirty hands need to touch the nuts

Nitrogen packed to eliminate the oxygen for long shelf life

New shaker cap design for convenience and functionality

Fits in the cup holder of your car

Resealable

Package can be recycled

Lightweight

Future developments would be to extend the packages to the conventional 12 oz can 500 ml can and possibly other variations, e.g., the tear away lid may be configured to tear away in such a manner as to provide an opening only as large as is needed to dispense the contents, i.e., a half opening end vs. a full open end.

It should be appreciated that various changes and modifications could be made to the examples of the invention described above, without departing from the spirit and scope of the invent For example, while the invention has been described primarily in the context of a two-piece DWI aluminium can, different types of cans and different materials could be used in conjunction with the novel dispensing cap. And changes to the design of the cap could be made as well while still preserving the important aspects of the inventive cap. In short, changes to the container and/or the cap could be made within the scope of the invention as defined only by the claims appended hereto.

What is claimed is:

1. A container containing a solid consumable and having a sealed end and a resealable and removable cap in addition to and over said sealed end, said cap having a dispensing opening with an opening area less than a cross-sectional area of said container for dispensing said solid consumable after opening of said sealed end of said container under said cap, wherein said cap includes first portion for sealing said dispensing opening and having a second portion, and wherein said first portion moves to unseal said dispensing opening in response to downward pressure on said second portion.

2. A container according to claim 1, wherein said container is a DWI container.

3. A container according to claim 1, wherein said first portion and second portion meet above a first opening such that pressing said second portion into said first opening causes said first portion to pivot upwardly to expose said dispensing opening.

4. A container according to claim 1, wherein said first portion seals said dispensing opening in response to downward pressure at location of said cap other than said second portion.

5. A container according to claim 1, wherein said container is a can and said opening has a diameter less than a diameter of said can.

6. A container according to claim 1, wherein said dispensing opening is resealable after dispensing said consumable such that an internal volume of said container is sealed by surfaces in contact with one another.

7. A container according to claim 1, wherein said consumable is a food item.

8. A container according to claim 7, wherein said consumable comprises nuts.

9. A container according to claim 1, wherein said sealed end comprises a tear-away metal lid.

10. A container according to claim 1, wherein said sealed end comprises a removable portion made of the same material as said container.

11. A container according to claim 1, wherein said sealed end comprises a removable portion that is substantially the entire end face of said container.

12. A container according to claim 1, wherein said cap is snap-fit to said container over said sealed end.

13. A container according to claim 1, wherein said resealable and removable cap is in addition to and over said sealed end, said sealed end comprises a removable portion and said dispensing opening dispenses said consumable after removal of said removable portion.

14. A container containing a solid consumable and having a sealed end and a resealable and removable cap in addition to and over said sealed end, said cap having a dispensing opening with an opening area less than a cross-sectional area of said container for dispensing said solid consumable after opening of said sealed end of said container under said cap, wherein said container includes a divider separating an interior of said container into plural compartments, and wherein said dispensing opening is movable to selectively position said opening above a selected one of plural compartments to permit dispensing of items contained in the selected compartment after opening of said sealed end.

15. A container according to claim 14, wherein said sealed end of said container includes a removable end portion at said sealed end of said container sealing said compartments that can be removed to open said sealed end.

* * * * *